US010452009B2

(12) United States Patent
Fujita et al.

(10) Patent No.: US 10,452,009 B2
(45) Date of Patent: Oct. 22, 2019

(54) FIXING APPARATUS INCLUDING CABLE RESTRICTION PORTION

(71) Applicant: CANON KABUSHIKI KAISHA, Tokyo (JP)

(72) Inventors: Keisuke Fujita, Sagamihara (JP); Takayuki Sugiyama, Hanoi (VN)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/630,732

(22) Filed: Jun. 22, 2017

(65) Prior Publication Data

US 2017/0371283 A1 Dec. 28, 2017

(30) Foreign Application Priority Data

Jun. 24, 2016 (JP) ..... 2016-125595

(51) Int. Cl.
*G03G 15/20* (2006.01)
*G03G 21/16* (2006.01)

(52) U.S. Cl.
CPC ..... *G03G 15/2042* (2013.01); *G03G 15/206* (2013.01); *G03G 15/2053* (2013.01); *G03G 15/2064* (2013.01); *G03G 21/1652* (2013.01); *G03G 2215/2016* (2013.01); *G03G 2215/2032* (2013.01); *G03G 2215/2035* (2013.01)

(58) Field of Classification Search
CPC . G03G 15/20; G03G 15/2082; G03G 15/2053
See application file for complete search history.

(56) References Cited

U.S. PATENT DOCUMENTS

| | | | | |
|---|---|---|---|---|
| 6,608,976 | B2 * | 8/2003 | Nishitani | G03G 15/2039 399/328 |
| 8,290,387 | B2 * | 10/2012 | Hara | G03G 15/2007 399/33 |
| 9,933,735 | B2 * | 4/2018 | Gon | G03G 15/2039 |
| 2002/0028089 | A1 * | 3/2002 | Yoneda | G03G 15/2064 399/122 |
| 2006/0269308 | A1 * | 11/2006 | Ishii | G03G 15/2039 399/69 |
| 2017/0255145 | A1 * | 9/2017 | Soshi | G03G 15/2053 |

FOREIGN PATENT DOCUMENTS

| | | | |
|---|---|---|---|
| JP | 10239170 | A * | 9/1998 |
| JP | 2011-081090 | A | 4/2011 |
| JP | 2011-118246 | A | 6/2011 |
| JP | 2011-123140 | A | 6/2011 |
| JP | 2012-252061 | A | 12/2012 |
| JP | 2014-191137 | A | 10/2014 |

OTHER PUBLICATIONS

English translation of JPH10239170 (A).*

* cited by examiner

*Primary Examiner* — Walter L Lindsay, Jr.
*Assistant Examiner* — Arlene Heredia
(74) *Attorney, Agent, or Firm* — Canon U.S.A., Inc. IP Division

(57) ABSTRACT

A heater holder includes a restriction portion and a recessed portion. The restriction portion determines the position of a cable in the longitudinal direction of the heater. The recessed portion, against which a bare conductive portion of the cable is to be positioned, is provided at a position that is different from the position of the restriction portion as viewed in a direction intersecting with the longitudinal direction. A wire is joined to the bare conductive portion somewhere between the restriction portion and the recessed portion.

5 Claims, 10 Drawing Sheets

FIXING APPARATUS INCLUDING CABLE RESTRICTION PORTION

BACKGROUND

Field

Embodiments of the disclosure relate to a fixing apparatus mounted in an image forming apparatus such as a copier or a printer, and more particularly to a fixing apparatus for fixing a recorded image on a recording medium.

Description of the Related Art

A film-heating scheme is known as an example of a fixing method of a fixing apparatus mounted in an electrophotographic copier or an electrophotographic printer. A film-heating fixing apparatus includes a cylindrical film, a heater, and a pressing roller. The heater is provided in contact with the inner surface of the film. A nip is formed by the pressing roller and the heater, with the film sandwiched therebetween. The heater is held by a heater holder made of resin. The heater holder is reinforced by a reinforcing member made of metal.

The heater holder has a through hole in its part in the longitudinal direction. A temperature detection element provided in a space between the heater holder and the reinforcing member detects the temperature of the heater through the through hole of the heater holder. The heater is controlled in accordance with the temperature detected by the temperature detection element. In addition to the temperature detection element, a protection element such as a thermostatic switch or a thermal fuse is provided in the space between the heater holder and the reinforcing member. The protection element also senses the heat of the heater through another through hole of the heater holder. The protection element has a function of cutting off the power to the heater when the temperature of the heater reaches an excessive level. An example of the structure described above is disclosed in Japanese Patent Laid-Open No. 2011-118246.

As disclosed in Japanese Patent Laid-Open No. 2011-118246, an electric cable that has an insulating sheath is used each for a signal line connected to a terminal of the temperature detection element. Since these electric cables are provided inside the film, not only insulating property but also heat-resisting property are required. As the speed of printing increases, so does a heater control target temperature. The higher target temperature makes it necessary to use an electric cable that has greater heat-resisting property and greater insulating property.

However, an electric cable that satisfies these requirements is expensive.

SUMMARY

In one aspect, the present disclosure is directed to providing a reliable fixing apparatus with a reduction in wiring cost.

A fixing apparatus according to another aspect of the present disclosure includes a cylindrical film, a heater provided in an inner space of the film, a holder holding the heater, a temperature detection element provided in the inner space of the film for detecting a temperature of the heater, a wire provided in the inner space of the film, one end of the wire being electrically connected to a terminal of the temperature detection element, and a cable electrically connected to the wire, wherein an unfixed image formed on a recording medium is fixed on the recording medium by the heat from the film, wherein the holder includes a restriction portion that determines a position of the cable in a longitudinal direction of the heater and a recessed portion to which a bare conductive portion of the cable is opposed, wherein the recessed portion is provided at a position that is different from a position of the restriction portion in a direction intersecting with the longitudinal direction, and wherein the wire is joined to the bare conductive portion somewhere between the restriction portion and the recessed portion.

Further features of the present disclosure will become apparent from the following description of exemplary embodiments with reference to the attached drawings.

DESCRIPTION OF THE EMBODIMENTS

First Embodiment

Figure 1A:
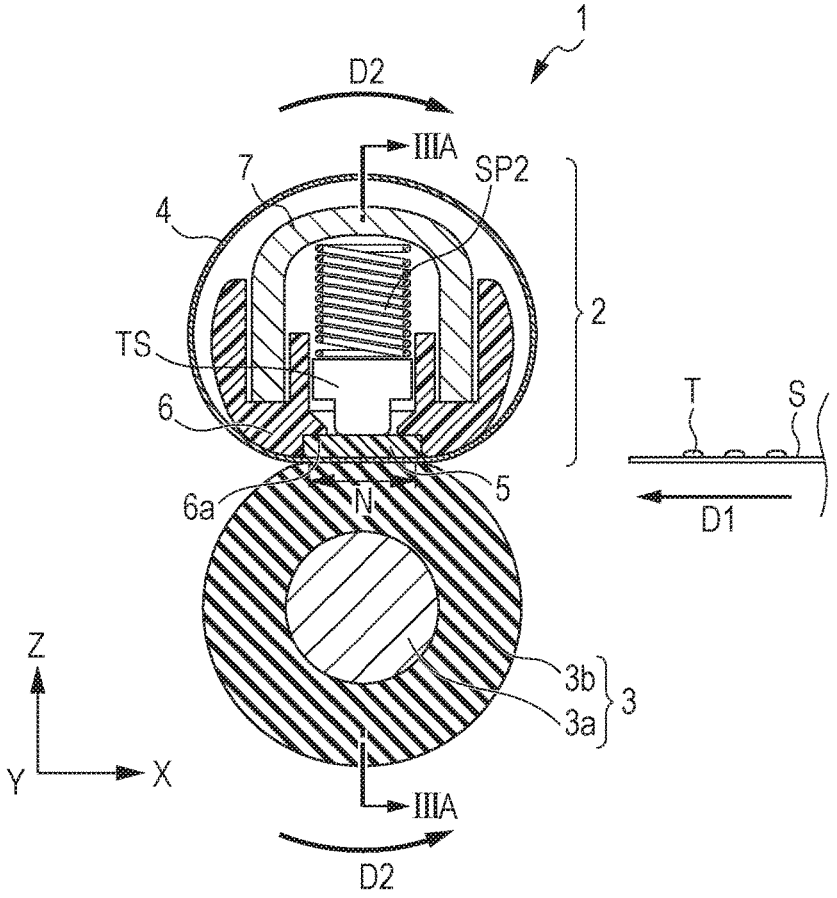
FIG. 1A is a cross-sectional view of a fixing apparatus according to an exemplary embodiment of the present disclosure.
Figure 1B:
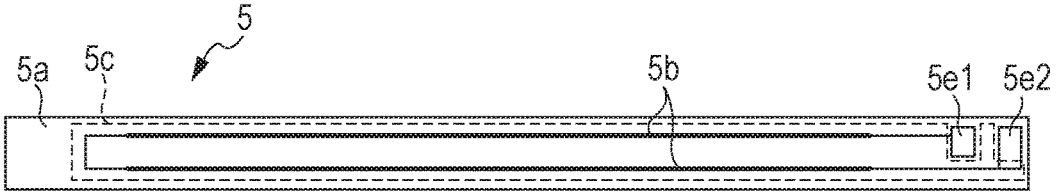
FIG. 1B is a structure diagram of a heater.
Figure 2A:
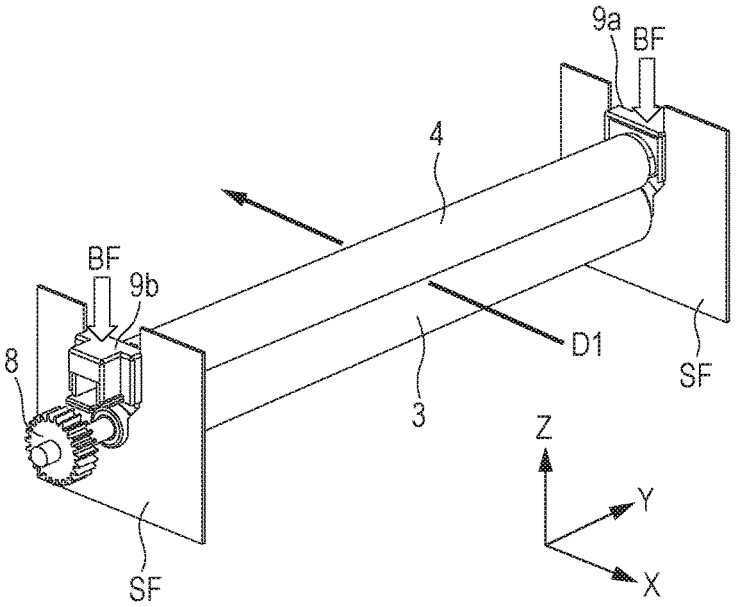
FIG. 2A is a perspective view of the fixing apparatus.
Figure 2B:
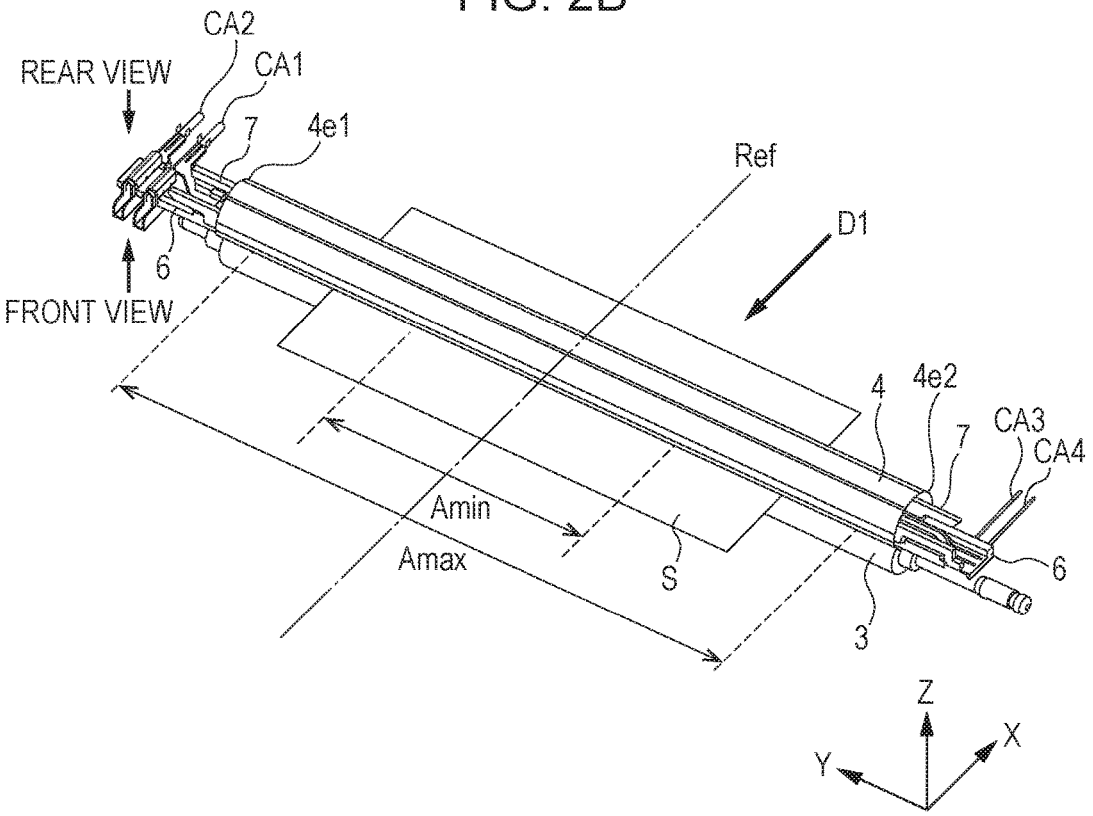
FIG. 2B is a perspective view of the fixing apparatus.
Figure 3A:
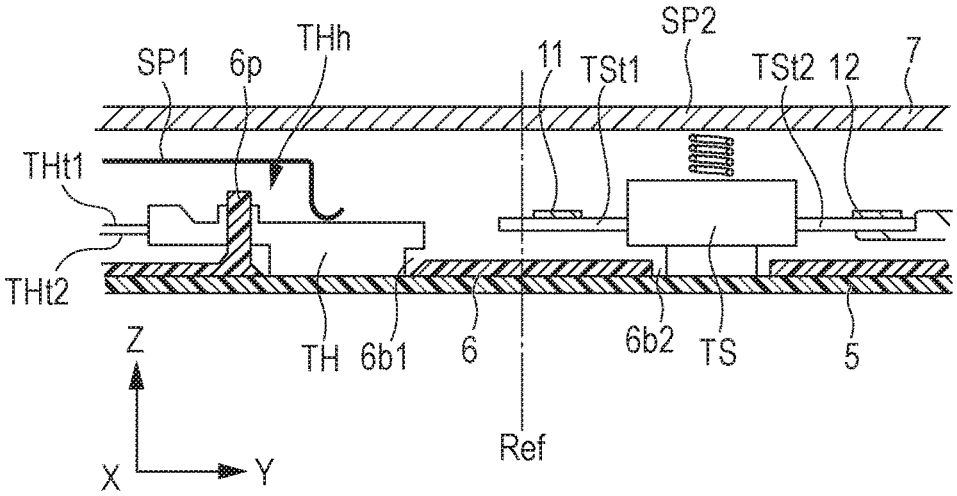
FIG. 3A is a cross-sectional view taken along the line IIIA-IIIA of FIG. 1A.
Figure 3B:
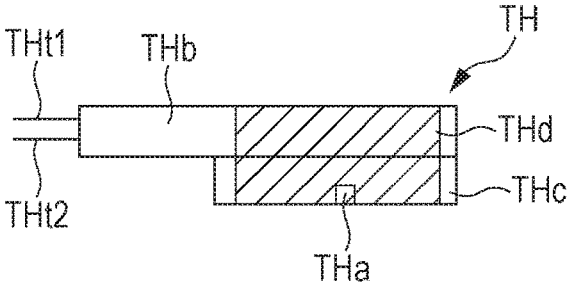
FIG. 3B is a structure diagram of a thermistor unit.
Figure 3C:
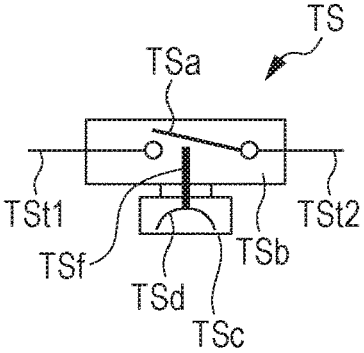
FIG. 3C is a structure diagram of a thermostatic switch.
Figure 4:
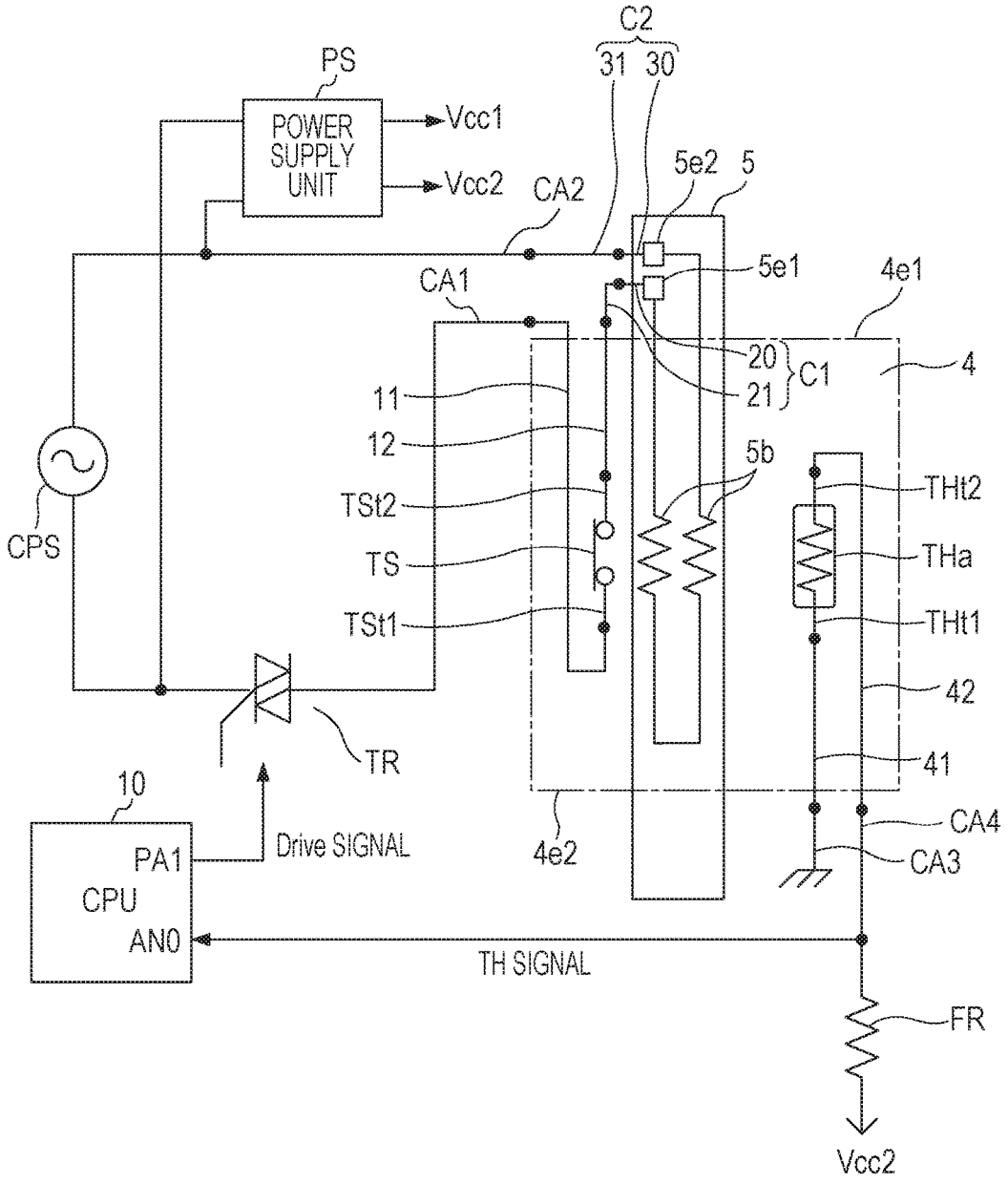
FIG. 4 is a wiring diagram.

FIG. 1A is a cross-sectional view of a fixing apparatus 1. FIG. 1B is a structure diagram of a heater 5. Each of FIGS. 2A and 2B is a perspective view of the fixing apparatus 1. FIG. 3A is a cross-sectional view of the inside of a film unit 2. FIG. 3B is structure diagram of a thermistor unit. FIG. 3C is a structure diagram of a thermostatic switch. FIG. 4 is a heater drive circuit diagram. In FIG. 2B, a state after the removal of components 8, 9*a*, 9*b*, and SF from the structure illustrated in FIG. 2A is illustrated. FIG. 3A is a cross-sectional view taken along the line IIIA-IIIA of FIG. 1A. With reference to these drawings, the basic structure of a fixing apparatus 1 will now be explained.

The fixing apparatus 1 of the present example is a film-heating fixing apparatus. The fixing apparatus 1 includes a film unit 2 and a pressing roller 3. The film unit 2 includes a cylindrical film 4, a heater 5, a heater holder 6, a stay (reinforcing member) 7, a thermistor unit TH, and a thermostatic switch (protection element) TS.

The film 4 is fitted roughly around the holder 6 and the stay 7. The film 4 includes a base layer and a surface layer (releasing layer). The base layer is made of a resin material such as polyimide or PEEK or is made of a metal material such as stainless or nickel. The surface layer is made of a material that excels in releasing property, for example, fluororesin.

The heater 5 is a ceramic heater. Heat generation resistors 5*b* are provided on a ceramic substrate 5*a*. Power is supplied to the heat generation resistors 5*b* via electrodes 5*e*1 and 5*e*2. The heat generation resistors 5*b* are coated with an insulating layer 5*c* made of glass or the like. The heater 5 is an elongated member that is long in a direction orthogonal to a direction D1 in which a recording medium is conveyed.

The holder 6 is a member for holding the heater 5 in the longitudinal direction of the heater 5. The holder 6 is made of thermoplastic resin. Specifically, the material of the holder 6 of the present example is LCP (Liquid Crystal Polymer). The holder 6 has a groove 6*a* for holding the heater 5. The groove 6*a* extends in the Y-axis direction.

The stay 7 is a reinforcing member that is provided in contact with the holder 6 in the longitudinal direction so as to reinforce the holder 6. The material of the stay 7 is metal (in the present example, a zinc-galvanized steel plate (iron)). The stay 7 ensures sufficient rigidity of the film unit 2. As illustrated in FIG. 1A, the stay 7 has a curved shape like an inverted letter U in cross section. Stoppers 9*a* and 9*b* are provided at the respective ends of the stay 7 in the longitudinal direction. The stoppers 9*a* and 9*b* prevent the film 4 from moving in a decentering manner in the lateral direction of the film 4.

The pressing roller 3 is an elastic roller that includes a metal core 3*a* made of iron or aluminum, etc. and a rubber layer 3*b* provided around the core 3*a*. A gear 8 is mounted on an end of the core 3*a*. The gear 8 is driven to rotate the pressing roller 3. The pressing roller 3 is supported rotatably on the frames SF of the fixing apparatus 1. The film unit 2 is attached to the frames SF over the pressing roller 3. A load indicated by an arrow BF is applied to each of the stoppers 9*a* and 9*b* from above. The load BF acts on the stopper 9*a*, 9*b*, the stay 7, the heater 5, the film 4, and the pressing roller 3 sequentially in this order. The loading forms a fixing nip N between the film 4 and the pressing roller 3. The pressing roller 3 rotates when the motive force of a motor (not illustrated) is transmitted to the gear 8. The film 4 rotates as follower due to the rotation of the pressing roller 3. A sheet of medium S bearing a recorded image (toner image) is conveyed to the fixing nip N therebetween. The toner image was formed by a non-illustrated image forming unit provided inside the body of the printer but has not been fixed yet. The medium S, with the unfixed image thereon, arrives at the fixing nip N to be nipped therebetween. Due to the heat of the heater 5, said image becomes fixed on the medium S.

The thermistor unit TH for detecting the temperature of the heater 5 is provided in a space between the holder 6 and the stay 7. The thermistor unit TH receives the heat of the heater 5 through a through hole 6*b* of the holder 6. The thermistor unit TH is inserted in a through hole 6*b*1 of the holder 6 and is urged onto the heater 5 by a leaf spring SP1. Due to the urging force, the thermistor unit TH is in contact with the heater 5. The thermistor unit TH is provided at an area where a recording medium of the smallest size available for use on the image forming apparatus (i.e., the minimum area Amin in FIG. 2B) is to pas "Amax" denotes an area where a recording medium of the largest size available for use on the image forming apparatus is to pass.

As illustrated in FIG. 3B, the thermistor unit TH includes a mount base portion THb, an elastic portion THc mounted on the mount base portion THb, a thermistor (temperature detection element) THa provided on the elastic portion THc, and an insulating sheet THd wrapped around them. "THh" denotes a hole for attachment of the thermistor unit TH to a pin 6*p* of the holder 6. The material of the mount base portion THb is LCP. The elastic portion THc has insulating property and includes ceramic sheets that are in layers. The material of the insulating sheet THd is polyimide. Two terminals THt1 and THt2 are electrically connected to the thermistor THa. The thermistor THa is an element the resistance value of which decreases as the temperature increases. The CPU 10 described later detects change in voltage in accordance with a change in the resistance value. The insulating sheet THd is in contact with the heater 5. The thermistor THa senses the temperature of the heater 5 via the insulating sheet THd. The thermistor THa may be provided on the heater by adhesive bonding or the like.

"TS" denotes a thermostatic switch that is a protection element. The thermostatic switch TS is provided on the path of power supply to the heater 5. The thermostatic switch TS has a function of cutting off the power to the heater 5 by turning OFF in a case of abnormal heat generation of the heater 5. Similarly to the thermistor unit TH, the thermostatic switch TS is provided in the space between the holder 6 and the stay 7 inside the film 4. The thermostatic switch TS is inserted in a through hole 6*b*2 of the holder 6 and is urged to be in contact with the heater 5 due to an urging force applied by a compression spring SP2 provided between the thermostatic switch TS and the stay 7. Similarly to the thermistor unit TH, the thermostatic switch TS is provided inside the area Amin. A thermal fuse may be used in place of the thermostatic switch.

FIG. 3C is a cross-sectional view of the thermostatic switch TS. "TSa" denotes a switch portion housed inside a case TSb made of resin. A heat-sensing portion TSc made of metal is provided on a part of the case TSb. The heat-sensing portion. TSc is in contact with the heater 5. "TSd" denotes a dome-shaped bimetal provided inside the heat-sensing portion TSc. "TSf" denotes a rod configured to be pushed up by the bimetal TSd. "TSt1" and "TSt2" denote terminals. The shape of the bimetal TSd reverses in a case of an abnormal rise in the temperature of the heater 5. The bimetal reversal lifts up the rod TSf to turn the switch portion TSa OFF.

FIG. 4 is a wiring diagram of the fixing apparatus 1. "CPS" denotes a commercial power source (alternating-current power source). The image forming apparatus in which the fixing apparatus 1 of the present example is mounted receives power supply from the commercial power source CPS "PS" denotes a power supply unit. The power supply unit PS outputs predetermined voltages (Vcc1=24 V, Vcc2=3.3 V) to loads such as a motor and a control circuit, etc. in the image forming apparatus.

The heater 5 is connected via a triode AC switch (drive element) TR and the thermostatic switch TS to the commercial power source CPS. The heater 5 generates heat by receiving AC power supplied from the commercial power source CPS.

The temperature of the heater 5 is monitored by the thermistor THa. One terminal THt1 of the thermistor THa is connected to the ground. The other terminal THt2 of the thermistor THa is connected to a fixed resistor FR. The terminal THt2 is connected to an input port AN0 of the CPU 10, too. A temperature table (not illustrated) is stored in the CPU 10. The CPU 10 detects the temperature of the heater 5 on the basis of a TH signal corresponding to a divided voltage obtained by the division of the resistance value of the thermistor THa and the resistance value of the fixed resistor FR.

The CPU 10 determines the duty ratio of the power supplied to the heater 5 so as to keep the temperature detected by the thermistor THa (TH signal) at the control target temperature. The CPU 10 outputs a Drive signal from an output port PA1 so as to drive the triode AC switch (drive element) TR, which is provided on the path of power supply to the heater 5, at the determined duty ratio.

As illustrated in FIG. 4, the heater 5 is provided in an AC circuit. Each of AC cables CA1 and CA2 is a stranded wire cable that has an insulating sheath on its surface. The AC cable CA1 is connected via a conductive component 11 to the terminal TSt1 of the thermostatic switch TS. The terminal TSt2 of the thermostatic switch TS is connected to a conductive component 12. The conductive component 12 is connected to a conductive component 21. The conductive component 21 is connected to a conductive component 20. The conductive component 20 is connected to the electrode 5e1 of the heater 5. The AC cable CA2 is connected to a conductive component 31. The conductive component 31 is connected to a conductive component 30. The conductive component 30 is connected to the electrode 5e2 of the heater 5. As illustrated in FIGS. 2B and 4, the wiring lines of the AC circuit are exposed to the outside from the end 4e1 of the cylindrical film 4.

The thermistor THa is provided in a DC circuit. A DC cable CA3, one end of which is grounded, is connected via a conductive component 41 to the terminal THt1 of the thermistor THa. A DC cable CA4 is connected via a conductive component 42 to the terminal THt2 of the thermistor THa. As illustrated in FIGS. 2B and 4, the wiring lines of the DC circuit are exposed to the outside from the end 4e2 of the cylindrical film 4.

Each of the conductive components 11, 12, 41, and 42 is an elongated bare conductor part that does net have an insulating sheath. As illustrated in FIGS. 3A and 4, the thermistor unit TH and the thermostatic switch TS are provided in the space between the holder 6 and the metal stay 7 inside the film 4. The conductive components 11, 12, 41, and 42 are also provided in said same space. The conductive components 11, 12, 41, and 42 are required to be insulated from the stay 7. Therefore, it is necessary that each of the conductive components 11, 12, 41, and 42 should be at a distance required for insulation from the stay 7. Therefore, in the present embodiment, metal plates without any insulating sheath and jumper wires without any insulating sheath are used as the conductive components 11, 12, 41, and 42 so as to ensure required conductive component rigidity and ensure a sufficiently long distance each from the stay 7. Wiring members that are constituents of the AC circuit and wiring members that are constituents of the DC circuit will now be explained in detail.

Structure of AC Circuit

Figure 5A:
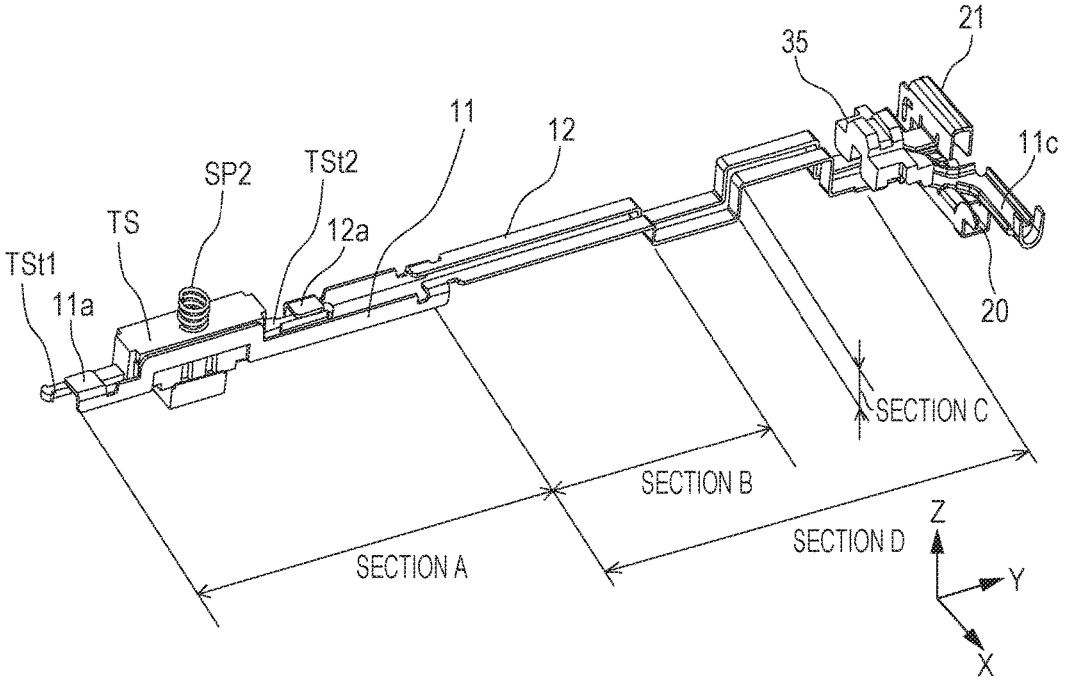
FIG. 5A is a perspective view of an AC circuit.

FIG. 5A is a perspective view of the AC circuit in the neighborhood of the thermostatic switch TS. The components 11 and 12 are made of metal plates (material: aluminum) (thickness: 0.4 mm) obtained by press working. The thermostatic switch TS is mounted in such an orientation that the terminals TSt1 and TSt2 are arranged in parallel to the longitudinal direction of the heater 5. There are two possible ways to direct the metal plate 11, which is connected to the terminal TSt1, to the outside of the cylindrical film 4: one is to direct the metal plate 11 to the outside through the end 4e2 of the film 4; the other is to bend the metal plate 11 back at its intermediate part to the outside through the end 4e1 of the film 4. In the former structure, the AC circuit is located in the neighborhood of the DC circuit, in which the thermistor unit TH is provided. Therefore, it is difficult to satisfy the requirement of a sufficient insulation distance between the AC circuit and the DC circuit. For this reason, the latter structure of bending the metal plate 11 back at its intermediate part to the outside through the end 4e1 of the cylindrical film 4 is advantageous, though not limited thereto.

Since the spring SP2 for urging the thermostatic switch TS is provided inside the film 4, a non-limiting advantageous structure requires some ingenuity in the shape of the metal plate 11. In the present example, the metal plate 11 is bent at an angle of 90° from a region where the thickness direction of the metal plate 11 is parallel to the direction in which the thermostatic switch TS is urged (Z-axis direction) (region 11a connected to the terminal TSt1) into an orientation in which the thickness direction of the metal plate 11 is parallel to the X axis (section A). This shape realizes a space-saving circuit structure by arranging the metal plate 11 on a side of the thermostatic switch TS. However, the section A of the metal plate 11 has high rigidity because the moment of inertia of area of the metal plate 11 is large in the direction in which the thermostatic switch TS is urged. Since the metal plate 11 is connected at its connected region 11a to the terminal TSt1 of the thermostatic switch TS, if the rigidity of the metal plate 11 in the Z-axis direction is excessively high, there is a possibility that urging by the spring SP2 might be hampered, resulting in unstable operation of the thermostatic switch TS. Therefore, the metal plate 11 is bent at an angle of 90° again into an orientation in which the thickness direction of the metal plate 11 is parallel to the direction in which the thermostatic switch TS is urged (Z-axis direction) (section B). The presence of the section B reduces the rigidity of the metal plate 11 in the Z-axis direction and makes the metal plate 11 less influential in the direction in which the thermostatic switch TS is urged, resulting in stable operation of the thermostatic switch TS.

The other metal plate, 12, is connected to the conductive component 21 that is a constituent of a connector C1 (described later) mounted on the holding member 6. The metal plate 12 (like the counterpart 11) becomes hot due to the heat transmitted from the heater 5. Therefore, thermal expansion occurs. Since the metal plate 12 is long in the longitudinal direction of the heater 5, the amount of stretching due to thermal expansion is large. The position of the connector C1 is fixed in relation to the holding member 6 at the conductor-side end of the metal plate 12, that is, the end connected to the conductive component 21, making stretching motion impossible at this end. On the opposite end, the connected region 12a of the metal plate 12 connected to the thermostatic switch TS is unable to stretch because the position of the thermostatic switch TS is fixed in relation to the holding member 6. Therefore, the force of stretching due to thermal expansion acts on the metal plate 12, with its both ends fixed, causing the warping of the metal plate 12 in the direction in which the thermostatic switch TS is urged (Z-axis direction). There is a possibility that urging by the spring SP2 might be hampered because of the warping, resulting in unstable operation of the thermostatic switch TS.

To avoid this, a section C is formed by bending the metal plate 12 into an orientation in which the thickness direction of the metal plate 12 is substantially parallel to the Y axis (the longitudinal direction of the heater 5). By this means, even if the metal plate 12 thermally expands, the warping of the metal plate 12 is reduced, thereby reducing an influence on the force of urging by the spring SP2. The section C acts as a buffer area for reducing the warping of the metal plate 12 due to thermal expansion.

The metal plate 11 also has a section C so as to reduce the warping of the metal plate 11. The metal plate 12 also has a section B so as to lower the rigidity of the metal plate 12 in the Z-axis direction. The section A of the metal plate 11 is provided at the same position in the Y-axis direction as the section A of the metal plate 12. The section B of the metal plate 11 is also provided at the same position in the Y-axis direction as the section B of the metal plate 12. The section C of the metal plate 11 is also provided at the same position in the Y-axis direction as the section C of the metal plate 12. Since the corresponding sections of the metal plates 11 and 12 are provided at the same position in the Y-axis direction as described above, it is possible to make the space occupied by these two metal plates smaller than otherwise.

Figure 5B:
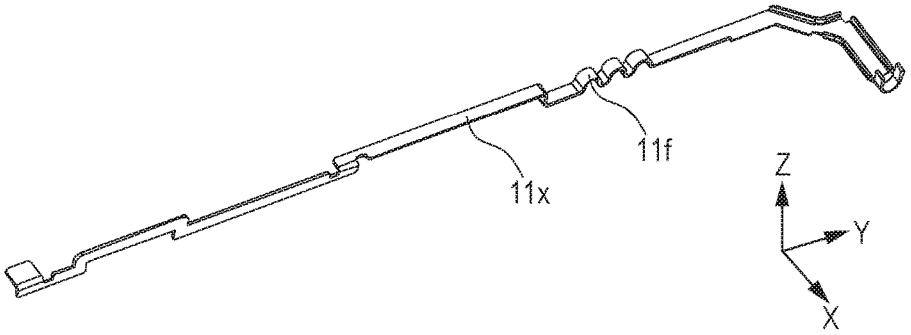
FIG. 5B is a variation example of a metal plate of the AC circuit.

As illustrated in FIG. 5B, the metal plate may have a corrugated portion that allows the metal plate to expand and contract in the longitudinal direction of the heater 5, thereby reducing an opposing force on the thermostatic switch TS. A metal plate 11*x*, which is a variation example of the metal plate 11, has a corrugated portion 11*f*. The pitch of the corrugated portion 11*f* becomes narrower when the thermal expansion of the metal plate 11*x* occurs. By this means, it is possible to reduce an opposing force on the thermostatic switch TS. Since the corrugated portion has plural ridges (three ridges in FIG. 5B), as compared with a single-ridge structure, it is possible to further reduce the rigidity of the metal plate 11*x* in the Y-axis direction and, therefore, it is possible to reduce the height of the corrugated portion in the Z-axis direction. This realizes a reduction in the size of the metal plate 11*x* in the Z-axis direction. The metal plate 12 also may have a corrugated portion.

Structure of DC Circuit

Figure 6:
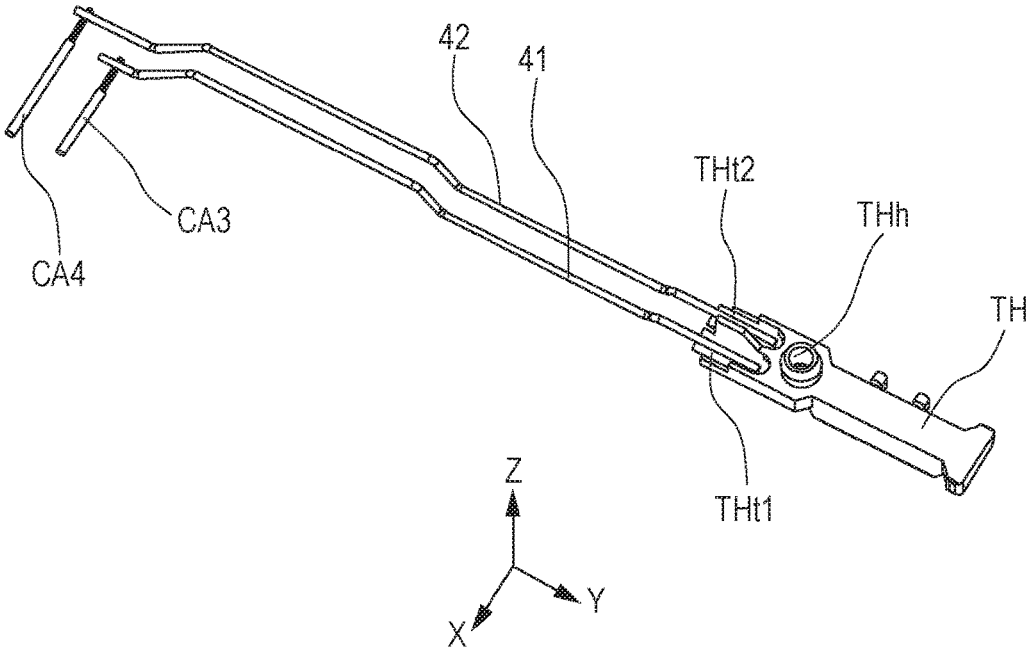
FIG. 6 is a perspective view of a DC circuit.

Next, with reference to FIG. 6, the structure of the DC circuit will now be explained. The thermistor unit TH has the terminals THt1 and THt2 at its one end in the longitudinal direction of the heater 5. Jumper wires 41 and 42 are used as the wires connected to these terminals. A jumper wire is a bare conductor wire that does not have an insulating sheath. In the present example, a lead-free solder plating annealed copper wire that has a diameter of 0.6 mm is used. One end of the wire 41 is welded to the terminal THt1. The other end of the wire 41 is soldered to the bare conductive portion (stripped wire) of the DC cable CA3. One end of the wire 42 is welded to the terminal THt2. The other end of the wire 42 is soldered to the bare conductive portion (stripped wire) of the DC cable CA4. The current value of the DC circuit is far smaller than that of the AC circuit, via which the power is fed to the heater. Therefore, a small cross-sectional area size of the wire 41, 42 is sufficient. For this reason, even if the thermal expansion of the wire occurs, it is easy to absorb the expansion by the flexion of the wire itself, meaning that the influence on the force of urging by the spring SP1, which urges the thermistor unit TH, is small. Therefore, a metal plate such as one used in the AC circuit described earlier may be used in place of the jumper wire.

The wire 41 and the bare conductive portion of the cable CA3 are connected to each other in such a way as to intersect with each other (in the present example, substantially at right angles). The same holds true for the wire 42 and the cable CA4. If the wire and the cable are connected to each other linearly, the range of overlap of the wire and the cable as viewed in the shorter-side direction of the heater 5 (X-axis direction) will be narrower. The narrower range of overlap will cause variations in contact area size depending on variations in position precision of the wire and the cable. For this reason, connection strength will be unstable. In contrast, if the bare conductive portion of the cable is connected to the wire substantially at right angles, a constant range of overlap will be obtained both in the shorter-side direction of the heater 5 (X-axis direction) and in the longitudinal direction of the heater 5 (Y-axis direction). Therefore, even if there are variations in position precision of the wire and the cable, connection strength will be stable.

Figure 7:
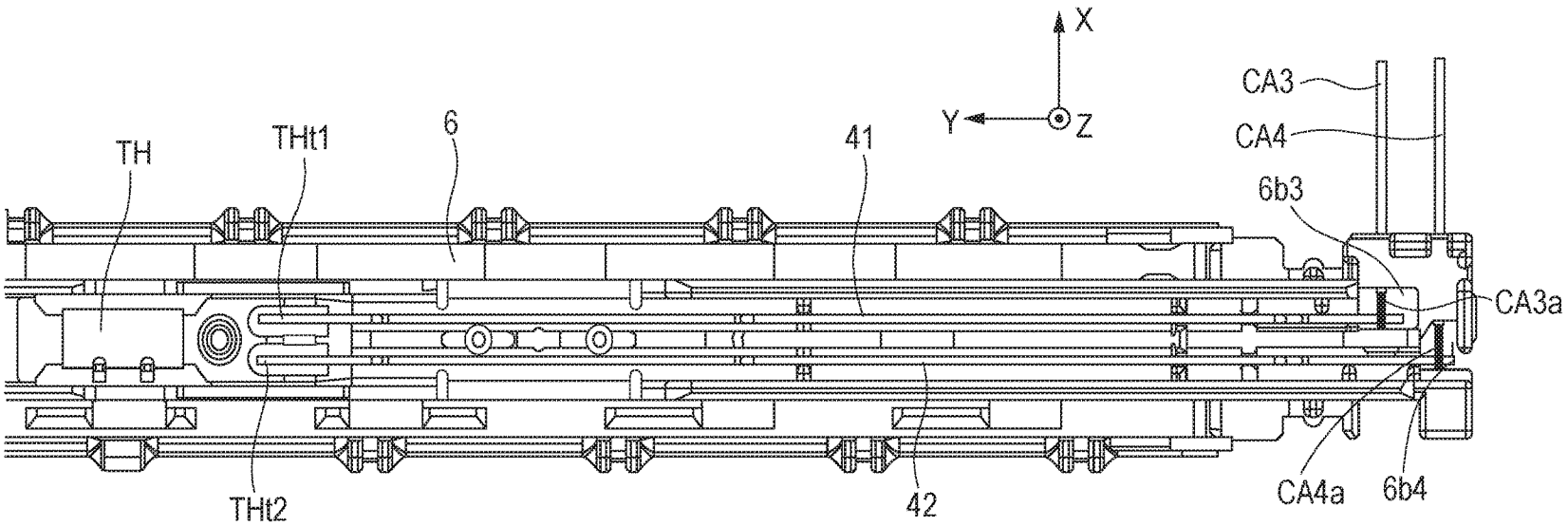
FIG. 7 is a diagram for explaining the connection of a wire and a cable to each other.
Figure 8A:
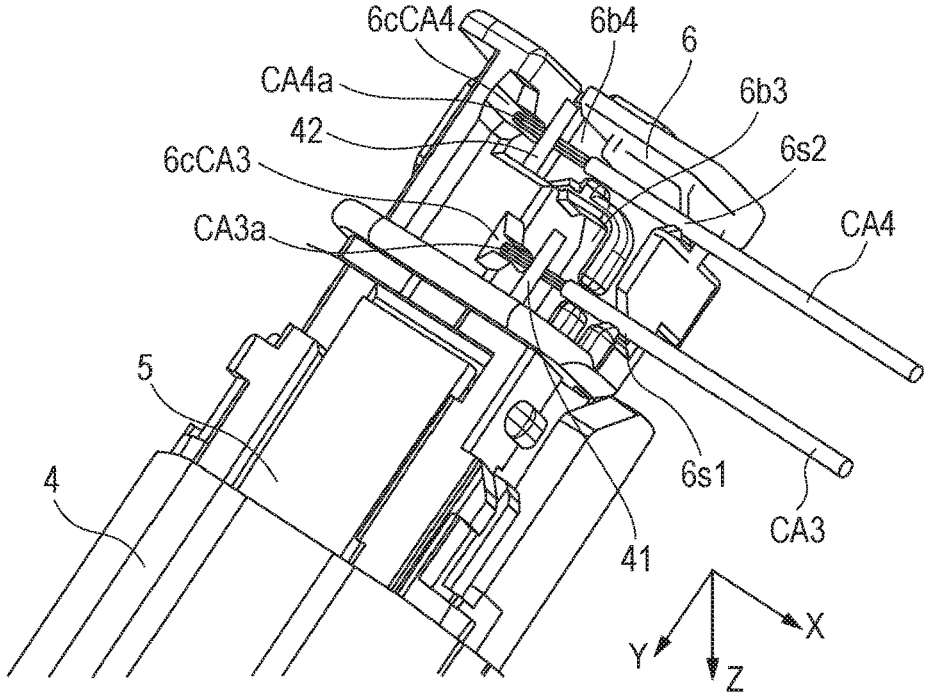
FIG. 8A is a diagram for explaining the connection of the wire and the cable to each other.
Figure 8B:
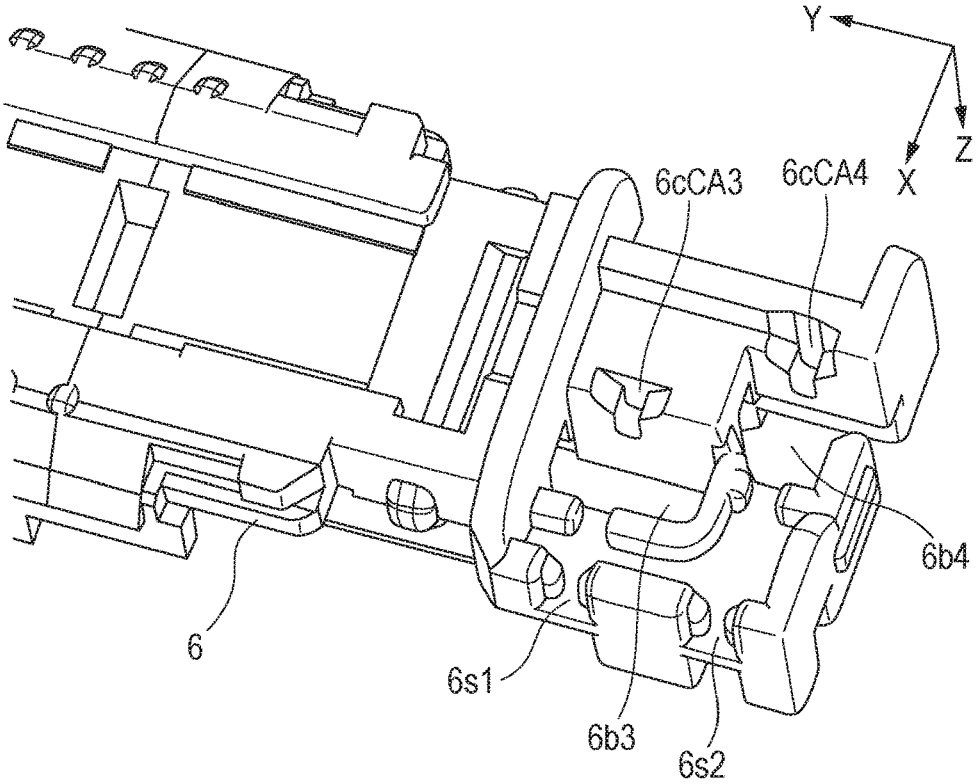
FIG. 8B a perspective view of the end portion of the holder in a state in which nothing is attached to the holder.
Figure 9A:
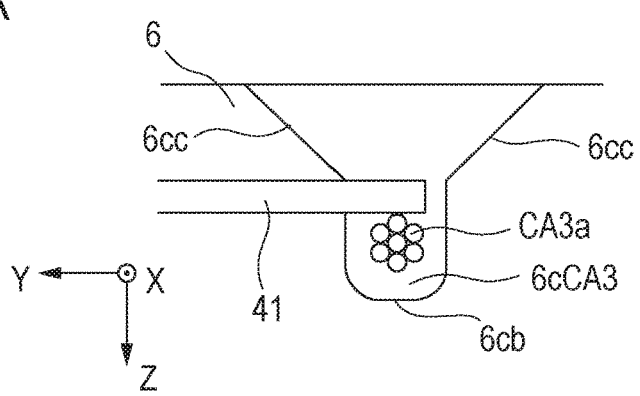
FIG. 9A is a diagram for explaining the connection of the wire and the cable to each other.
Figure 9B:
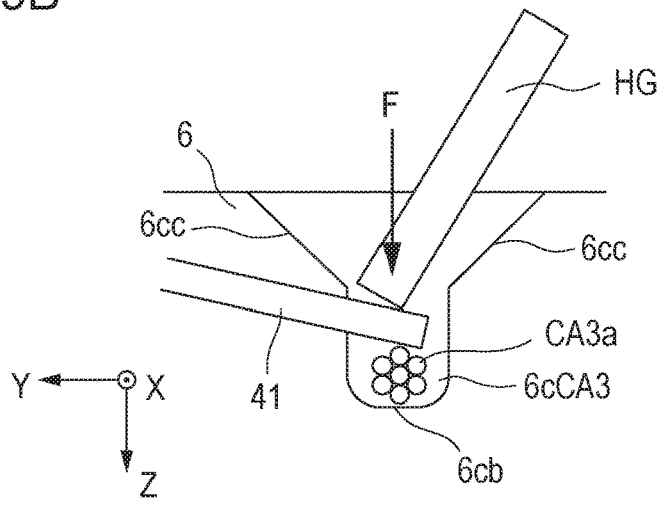
FIG. 9B is a diagram for explaining the connection of the wire and the cable to each other.
Figure 9C:
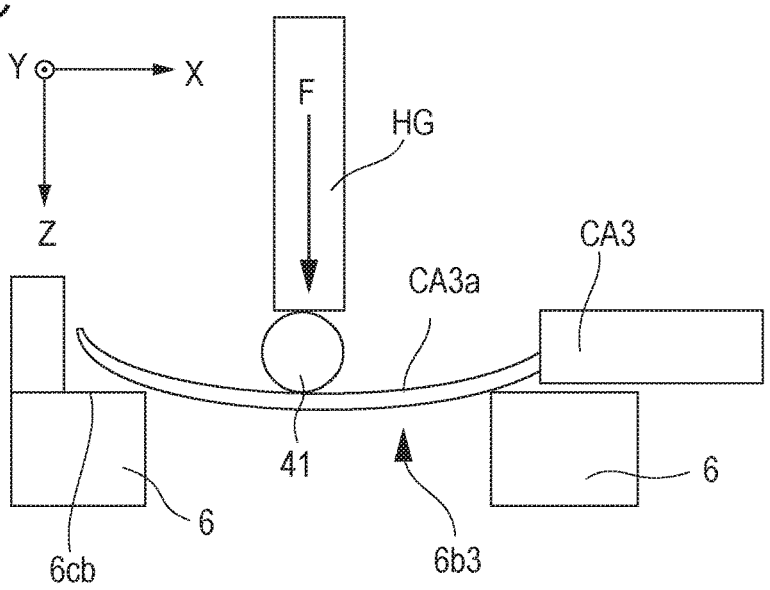
FIG. 9C is a diagram for explaining the connection of the wire and the cable to each other.

Next, with reference to FIGS. 7, 8, 9A, 9B, and 9C, the structure of the joined region of the wire 41 (42) and the cable CA3 (CA4), including the neighborhood of the joined region, will now be explained. FIG. 7 is a plan view of a state in which the heater 5, the wires 41 and 42, and the cables CA3 and CA4, etc. are attached to the holder 6. FIG. 8A is a perspective view of an end portion of the holder 6 in the attached state. FIG. 8B is a perspective view of the end portion of the holder 6 in a state in which nothing is attached to the holder 6. Each of FIGS. 9A, 9B, and 9C is a diagram showing a positional relationship between the wire 41 and the bare conductive portion CA3*a* of the cable CA3.

As described earlier, the fixing apparatus 1 of the present example includes the cylindrical film 4, the heater 5 provided inside the film 4, the holder 6 holding the heater 5, and the temperature detection element THa provided inside the film 4 for detecting the temperature of the heater 5. In addition to them, the fixing apparatus 1 of the present example includes the wire 41 (42) and the cable CA3 (CA4). The wire 41 (42) is provided inside the film 4 on the opposite surface of the holder 6 having a surface for holding the heater 5. Said opposite surface is the opposite of said heater-holding surface. One end of the wire 41 (42) is connected to a terminal of the temperature detection element THa. The cable CA3 (CA4) is connected to the wire 41 (42).

The wire 41 (42) and the bare conductive portion of the cable CA3 (CA4) are joined to each other by soldering. When soldering is used for joining the wire and the bare conductive portion of the cable to each other, it is necessary to heat the two to an appropriate temperature by means of a soldering iron. Unless the two are heated properly, solder does not melt properly to join onto the material of each of the two, resulting in insufficient conductivity and insufficient connection strength. To avoid poor soldering, in a soldering process, it is necessary to make sure that the wire and the bare conductive portion of the cable are securely in contact with each other so that heat will be transferred sufficiently from the soldering iron to the wire and the bare conductive portion of the cable. An example of a technical structure for ensuring secure contact will now be explained.

As illustrated in FIGS. 7 and 8A, the connection position of the wire 41 (42) and the bare conductive portion of the cable CA3 (CA4) is a position corresponding to an end portion of the holder 6 in the longitudinal direction of the heater 5 (Y-axis direction). As illustrated in FIGS. 7, 8A, and 8B, the holder 6 has two hole portions 6*b*3 and 6*b*4 elongated in the Y-axis direction. The end of the wire 41 is located at the hole portion 6*b*3. The end of the wire 42 is located at the hole portion 6*b*4. That is, the hole portion 6*b*3 (6*b*4) for through-hole communication of the surface for holding the heater 5 with the opposite surface is provided at a region of the holder 6 corresponding to the joint of the wire 41 (42) and the bare conductive portion CA3*a* (CA4*a*).

As illustrated in FIG. 7, the most part of the wire 41 (42) is provided at the side of the opposite surface of the holder 6, which is the opposite of the surface for holding the heater 5. However, as illustrated in FIGS. 7 and 8A, the end of the wire 41 (42) is provided at the side of the surface for holding the heater 5 through the hole portion 6*b*3 (6*b*4). The wire 41 (42) is connected to the bare conductive portion CA3*a* of the cable at the side of the surface, of the holder 6, for holding the heater 5.

As illustrated in FIG. 8A, slit portions (restriction portions) 6*s*1 and 6*s*2 for determining the respective positions of the two cables CA3 and CA4 in the Y-axis direction are provided at the side of the surface, of the holder 6, for holding the heater 5. The slit portions (restriction portions) 6*s*1 and 6*s*2 are located outside the area, of the hider 6, for holding the heater 5 in the Y-axis direction. The cables CA3 and CA4 are fitted in the slit portions 6*s*1 and 6*s*2 respectively. As described above, the temperature detection element THa has two terminals, to each of which a corresponding wire is connected; two cables are connected to the two wires respectively; the respective positions of the two cables are determined by the two restriction portions 6*s*1 and 6*s*2, the position of one of which is different from the position of the other in the longitudinal direction of the heater.

FIG. 9A is an enlarged view of the joined region of the wire 41 and the cable CA3. The structure of the joined region of the wire 42 and the cable CA4 is the same as the illustrated structure. Therefore, in the description below, the joined region of the wire 41 and the cable CA3 is taken as an example.

As illustrated in FIG. 9A, in comparison with the wire 41, the bare conductive portion CA3*a* of the cable CA3 is positioned relatively at the side of the opposite surface, which is the opposite of the surface for holding the heater. The end of the bare conductive portion CA3*a* is positioned in a recessed portion 6*c*CA3 of the holder 6. The recessed portion 6*c*CA3 has a tapered portion 6*cc* for guiding the bare conductive portion CA3*a* into the recessed portion 6*c*CA3. Because of the tapered structure, it is easy to put the bare conductive portion CA3*a* into the recessed portion. 6*c*CA3. The recessed portion 6*c*CA3 has an opposing portion 6*cb* facing the +Z-directional part of the bare conductive portion CA3*a*.

As illustrated in FIGS. 9B and 9C, in the process of soldering the wire 41 and the bare conductive portion CA3*a* together, a pressing force is applied to the wire 41 by means of a soldering iron HG as indicated by an arrow F. When the wire 41 is pressed by the soldering iron HG, the wire 41 is in contact with the bare conductive portion CA3*a*, and the bare conductive portion CA3*a* is pressed against the opposing portion 6*cc*. At this point in time, the bare conductive portion CA3*a* is supported in a bridge state by the holder 6 as illustrated in FIG. 9C. Although the force F is applied to the wire 41, the bare conductive portion CA3*a* sustains the force F. Therefore, the contact pressure of the soldering iron HG and the wire 41 and the contact pressure of the wire 41 and the bare conductive portion CA3*a* are stable. This makes the supply of heat from the wire 41 to the bare conductive portion CA3*a* stable and makes soldering easier. The pre-tinning of the bare conductive portion CA3*a* ensures more reliable soldering.

As described above, the holder 6 has the restriction portion 6*s*1 (6*s*2) for determining the position of the cable CA3 (CA4) in the longitudinal direction of the heater 5. In addition, the holder 6 has the recessed portion 6*c*CA3 (6*c*CA4), against which the bare conductive portion of the cable is to be positioned, wherein the recessed portion is provided at a position that is different from the position of the restriction portion as viewed in the direction intersecting with the longitudinal direction. The wire 41 (42) is joined to the bare conductive portion somewhere between the restriction portion and the recessed portion.

Figure 10:
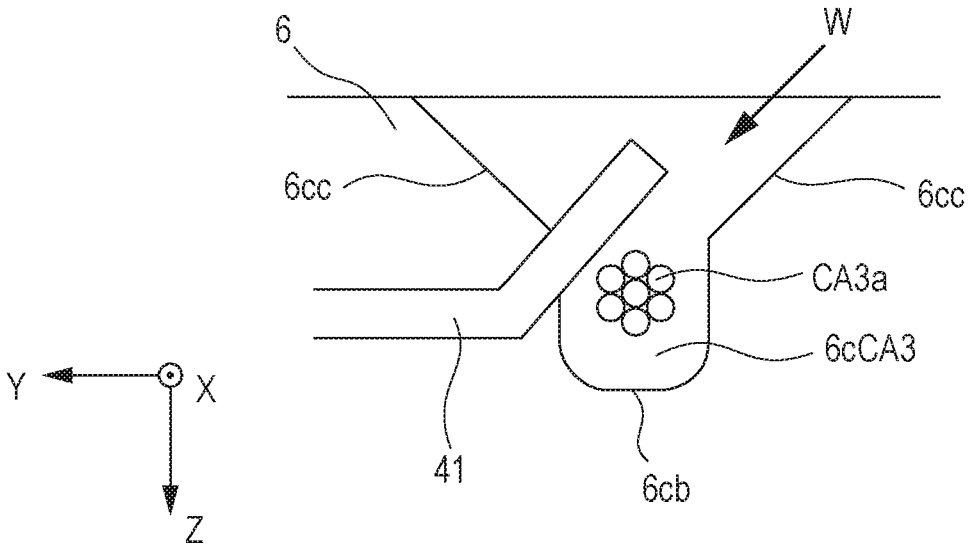
FIG. 10 is a diagram illustrating a variation example of the embodiment.

A variation example is illustrated in FIG. 10. As illustrated in FIG. 10, the tip portion of the wire 41 may be bent toward the opening edge of the recessed portion 6*c*CA3. In the process of setting the cable CA3 with respect to the holder 6 to which the wire 41 is attached, the structure of the variation example makes it possible to insert the cable CA3 in a direction indicated by an arrow W. This makes it easier to set the cable CA3. The tip portion of the wire 42 also may be bent similarly.

In the apparatus of the present example, even when the cable CA3 (CA4) is under external stress, it is possible to mitigate the effects of the external stress on the joint of the wire and the cable because the position of the cable is restricted by the slit portion 6*s*1 (6*s*2). The slit portion (restriction portion) 6*s*1 (6*s*2) is located outside the area, of the holder 6, for holding the heater 5 in the longitudinal direction of the heater 5. That is, the joint of the wire and the cable is located outside the heater 5 in the Y-axis direction. Therefore, the effects of the heat of the heater 5 on the cable CA3 (CA4) are mitigated. Therefore, it is possible to use a low-cost cable of inferior heat-resisting property. As can be seen from FIG. 2B, the slit portion (restriction portion) 6*s*1 (6*s*2) is located outside the end 4*e*2 of the film 4 in the Y-axis direction. Moreover, the position of the slit portion 6*s*1 and the position of the slit portion 6*s*2 are different from each other in the Y-axis direction. Therefore, the position of the joint of the wire 41 and the cable CA3 and the position of the joint of the wire 42 and the cable CA4 are different from each other in the Y-axis direction. Because of the difference between the positions of the joints, it is possible to avoid a combination error from occurring in the process of joining the two cables to the two wires respectively.

In the foregoing example, the cable is joined to the wire in such a way that the axial-line direction of the wire and the axial-line direction of the cable are substantially perpendicular to each other. However, the angle of intersection is not limited to the right angle or the like. It suffices if the two intersects with each other.

The foregoing disclosure makes it possible to provide a reliable fixing apparatus with a reduction in wiring cost.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-125595 filed Jun. 24, 2016, which is hereby incorporated by reference herein in its entirety.

What is claimed is:

1. A fixing apparatus; comprising:

a cylindrical film having an inner space;

a heater provided in the inner space of the cylindrical film;

a holder holding the heater and including a through hole in a longitudinal direction of the heater;

a temperature detection element provided in the inner space of the cylindrical film and configured to detect a temperature of the heater, wherein the temperature detection element is inserted in the through hole of the holder and in contact with the heater due to pressure applied by a spring;

a wire provided in the inner space of the cylindrical film, wherein one end of the wire is electrically connected to a terminal of the temperature detection element, and the other end of the wire is exposed to an outside from an end of the cylindrical film in the longitudinal direction; and a cable electrically connected to the wire, wherein the other end of the wire and the cable are connected with each other at an outside of the cylindrical film, wherein, in a case where an unfixed image is formed on a recording medium, the unfixed image is fixed on the recording medium by the heat from the cylindrical film, wherein the holder includes a restriction portion configured to determine a position of the cable in the longitudinal direction of the heater and a recessed portion to which a bare conductive portion of the cable is opposed, wherein the recessed portion is provided at a position that is different from a position of the restriction portion in a direction intersecting with the longitudinal direction, wherein the restriction portion and the recessed portion are provided at a position of the holder outside of the cylindrical film, and wherein the wire is joined to the bare conductive portion somewhere between the restriction portion and the recessed portion.

2. The fixing apparatus according to claim 1, wherein solder joins the wire and the bare conductive portion to each other.

3. The fixing apparatus according to claim 1, wherein the through hole is configured to provide through-hole communication of a holding surface of the holder for holding the heater with an opposite surface of the holder at a region of the holder corresponding to a joint of the wire and the bare conductive portion.

4. The fixing apparatus according to claim 1, wherein the recessed portion has a tapered portion for guiding the bare conductive portion into the recessed portion.

5. The fixing apparatus according to claim 1, wherein the wire is a first wire and a second wire, wherein the temperature detection element has a first terminal that corresponds to and is connected to the first wire and a second terminal that corresponds to and is connected to the second wire, wherein the cable is a first cable connected to the first wire and a second cable connected to the second wire, and wherein the restriction portion includes a first restriction portion configured to determine a position of the first cable and having a first position, and a second restriction portion configured to determine a position of the second cable and having a second position that is different from the first position of the first restriction portion in the longitudinal direction of the heater.

* * * * *